US007749041B2

(12) United States Patent
Leleu

(10) Patent No.: US 7,749,041 B2
(45) Date of Patent: Jul. 6, 2010

(54) PUPPET THEATER AND THEATER COMBINATION

(76) Inventor: Lisa Annette Leleu, 100 Mechanics St., Doylestown, PA (US) 18901

( * ) Notice: Subject to any disclaimer, the term of this patent is extended or adjusted under 35 U.S.C. 154(b) by 174 days.

(21) Appl. No.: 11/893,983

(22) Filed: Aug. 18, 2007

(65) Prior Publication Data

US 2009/0036017 A1 Feb. 5, 2009

Related U.S. Application Data

(60) Provisional application No. 60/838,798, filed on Aug. 18, 2006.

(51) Int. Cl.
*A63H 33/38* (2006.01)
*A63H 33/00* (2006.01)

(52) U.S. Cl. ..... 446/82; 446/147; 446/472; 446/478

(58) Field of Classification Search ..... 446/71–77, 446/82–84, 147, 148, 327, 328, 329, 330, 446/339, 108, 110–115, 296, 337, 338
See application file for complete search history.

(56) References Cited

U.S. PATENT DOCUMENTS 984,735 A * 2/1911 Bailey ..... 446/82
1,583,775 A * 5/1926 Brandt ..... 446/82
D140,922 S * 4/1945 Wise ..... D21/506
4,030,235 A * 6/1977 Terzian et al. ..... 446/296
4,342,173 A * 8/1982 Otake ..... 446/472
4,764,142 A * 8/1988 Griffith et al. ..... 446/82
5,261,849 A 11/1993 French
5,352,149 A * 10/1994 Melashenko et al. ..... 446/478
5,733,165 A * 3/1998 Kelley ..... 446/73
6,068,556 A * 5/2000 Bernstein ..... 472/77
6,398,659 B1 * 6/2002 Karg ..... 472/62
6,672,929 B2 * 1/2004 Leleu ..... 446/72
6,782,905 B2 * 8/2004 Chu et al. ..... 135/143
7,467,985 B2 * 12/2008 Manrique ..... 446/147

* cited by examiner

*Primary Examiner*—Nini Legesse
(74) *Attorney, Agent, or Firm*—Richard R. Clikeman; Nathaniel Gordon-Clark

(57) ABSTRACT

A portable theater for children that has multiple features of a theater integrated together. The portable theater has a stage, refreshment stand, ticket booth and alternatively a dressing room or puppet theater. Each side of theater has one element for a total of four elements in any given theater. The theater allows children to enact not only a performance, but also other aspects of the theater experience like selling tickets, selling refreshments and changing between scenes.

14 Claims, 12 Drawing Sheets

PUPPET THEATER AND THEATER COMBINATION

CROSS-REFERENCE TO RELATED APPLICATIONS

This application claims the benefit of Provisional Patent Application Ser. No. 60/838,798, filed Aug. 18, 2006 by the present inventor.

FEDERALLY SPONSORED RESEARCH

None

SEQUENCE LISTING OR PROGRAM

None

FIELD OF INVENTION

This invention relates to theaters. More specifically it relates to portable theaters. Even more specifically it relates to children's portable theaters.

BACKGROUND OF THE INVENTION

The use of theaters for housing performances is well known in the art. Most theaters are in fixed locations and cannot be moved. Furthermore, most theaters are constructed for use by adults. Yet, it is well known that children enjoy staging plays and other theatrical productions. Furthermore, children want to do more than just stage a play. They would like to enact all elements of the theater experience. This includes enacting selling tickets at a box office and selling refreshments at a refreshment stand. The present invention is a single theater that is portable and allows children to enact not only a play or puppet show, but also sell tickets through a box office, maintain a dressing room and serve refreshments through a refreshment stand, all in an integrated structure.

An example of a tent used as a theater is U.S. Pat. No. 5,261,849, by French. The '849 patent is a tent for performing marionette performances. It consists of an opening with a platform upon which to stage the marionette performances. This invention is specifically limited to marionettes and cannot accommodate other types of puppet performances. It certainly cannot accommodate live performance with people. It also is just a marionette stage. It does not have any other features of a theater, such as a dressing room, ticket booth or refreshment stand. The invention is this application fixes these defects in the portable theater area.

SUMMARY OF INVENTION

The invention is a portable theater for children. The purpose of the invention is to allow children to perform plays and other theater productions using an actual theater. The theater can be adapted to the need of the children and can be decorated by them.

The theater is a tent with fabric walls. The preferred embodiment is a rectangular tent with a nylon shell. The size of the tent is such that a child can stand in the tent without touching the roof or top of the theater. The tent is supported by a frame made of rods. The rods fit into junctions to form the shape of the theater. The rods and the junctions could use plastic, metal, fiberglass, wood, carbon or aluminum. Still other versions could use a cloth shell. Some versions of the theater tent could use wood planks, plastic panels or cardboard as the shell.

The theater tent has a theater side that is open. On this side children can stand in the theater and perform a play or other theater production. This opening is the size of most of the side of the theater tent. The theater side of the theater tent has a frame so that the sides and top have a small frame around the theater opening. The theater opening may also have a frame on the bottom of the opening.

The theater tent can also have a puppet theater side that is adapted to puppet shows and puppet theatrical productions. The puppet side is a solid sheet of fabric with openings for puppets to be inserted. These opening can be placed on the seams of the fabric or in the middle of the fabric. The opening can also be a larger opening that multiple puppets can fit into the opening. The preferred embodiment of the larger opening is large enough to create a rectangular opening that runs the lengths, but not the height of the puppet side of the theater tent.

The theater side of the theater tent can have a puppet stage board that attaches to the opening to allow puppet shows on the theater side of the theater tent. The puppet stage board can be reversibly attached to the shell. Alternatively, the puppet stage can be reversibly attached to the frame of the theater tent. Alternatively still, the puppet stage board can be permanently attached to the theater tent.

The other two sides of the theater tent can be adapted to other theater related uses. In a preferred embodiment, one side could be a refreshment stand and the other could be a ticket booth. The side openings are of a size that would allow these uses. Furthermore, the puppet theater side can be alternatively structured as a dressing room.

These other elements of the theater can have special features for each use. The ticket booth can have a clock and pockets for displaying pictures of the actors. The refreshment stand can have pockets to display a menu and a clock. The dressing room can have a door opening to the theater side, a clock, storage pockets and reflective surfaces, such as mirrors.

In the preferred embodiment, all openings can have inserts placed into them. The openings have a means of attachment to support the inserts. The inserts can be flexible or rigid. The preferred embodiment envisions an insert made of dry-erase board. In this embodiment, the children can decorate the dry-erase board and then erase the drawings to use the boards again. In another preferred embodiment, the inserts are sections of fabric. The children can attached items to the fabric by a hook and loop fastener, snaps, hooks, buttons, adhesives, or magnets.

Although this invention has been illustrated by reference to specific embodiments, it will be apparent to those skilled in the art that various changes and modification may be made which clearly fall within the scope of the invention.

BRIEF DESCRIPTION OF THE DRAWINGS

The accompanying drawings, which are incorporated in and form part of the specification, illustrate the embodiments of the present invention and, together with the description, serve to explain the principles of the invention.

DETAILED DESCRIPTION OF THE DRAWINGS

Figure 1:
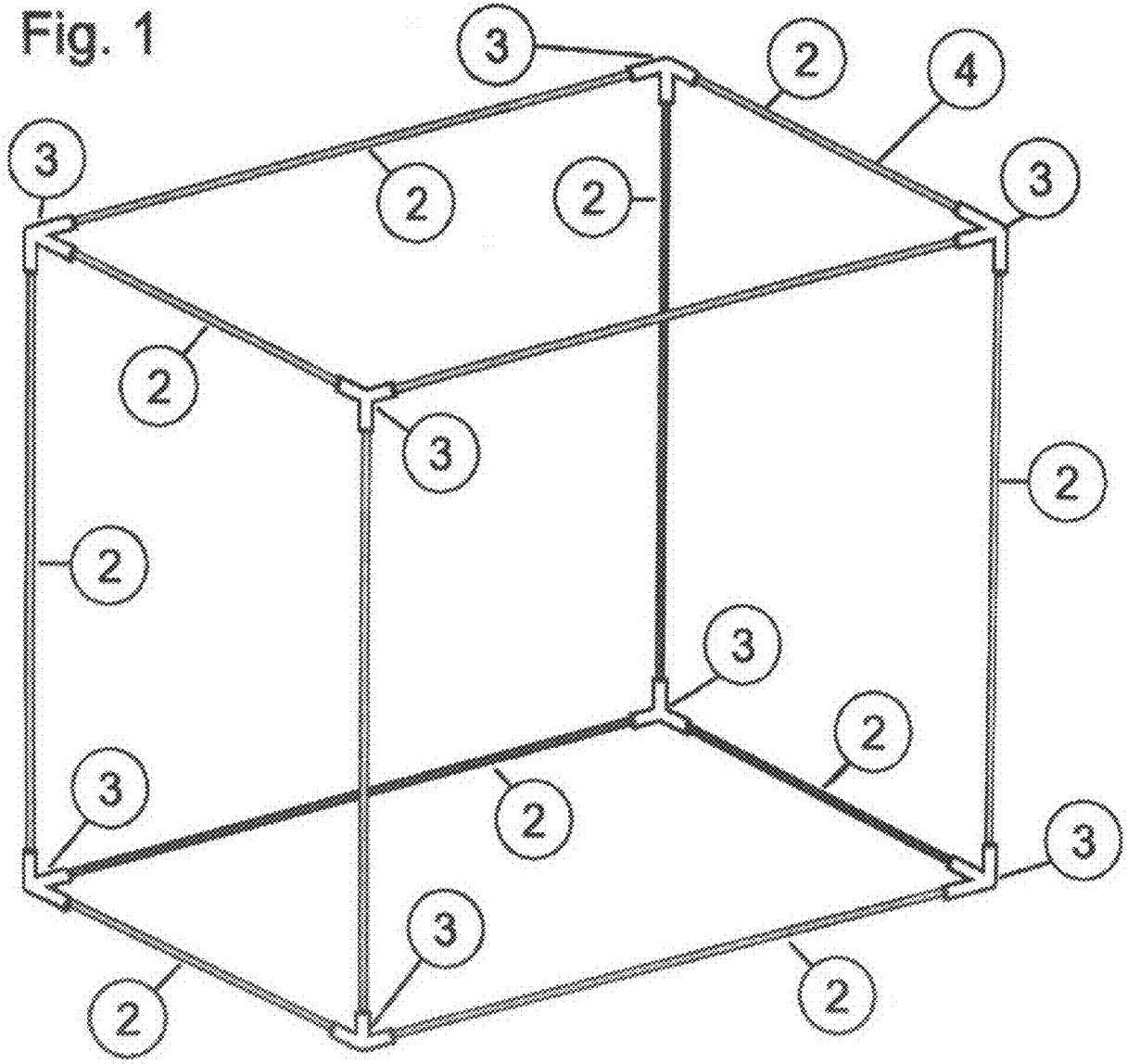
FIG. 1 is a picture of the theater tent frame.

FIG. 1 illustrates the theater tent frame. The frame 4 is made of rods 2. The rods 2 are jointed at the joints 3.

Figure 2:
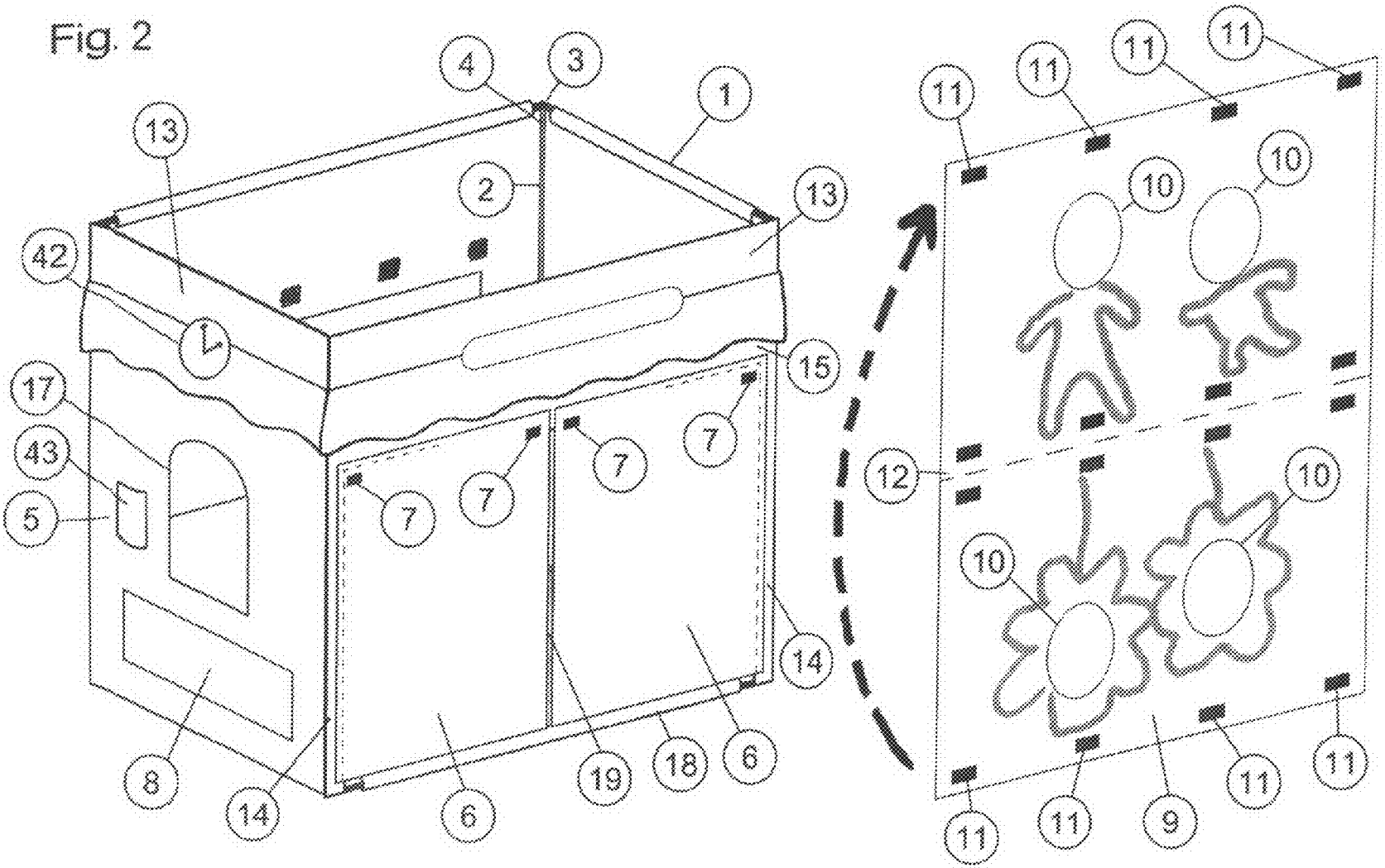
FIG. 2 is a picture of the theater side of the theater tent.

FIG. 2 illustrates the theater side of the theater tent. The theater tent 1 comprises fabric 13 placed over a frame 4. The theater tent 1 has four sides and a top side and a bottom side. The frame 4 is made of rods 2 and joints 3. The theater tent 1 has a theater side 18 and a refreshment stand side 5. The theater side 18 has an opening 19. The refreshment stand side 5 has a refreshment opening 17, pocket 43 and clock 42. The refreshment stand side 5 also has message board 8. The theater side 18 has curtains 6 with fasteners 7. The theater side opening 19 has sides 14 and top 15. The theater tent 1 has a theater stage board 9. The theater stage board 9 can be folded on bend 12. The theater stage board 9 has opening 10 and fasteners 11.

Figure 3:
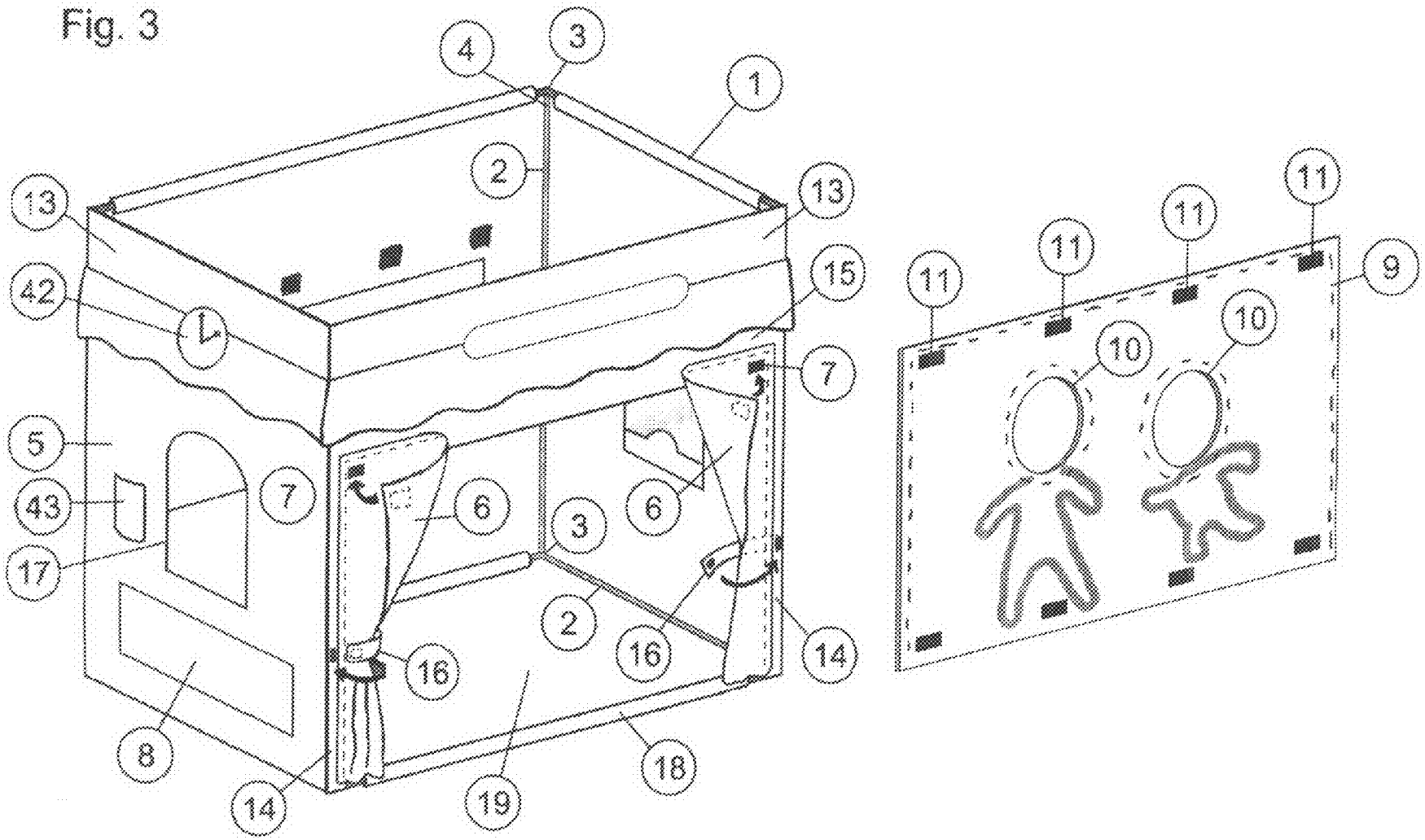
FIG. 3 is a picture of the theater side of the theater tent with the curtain open.

FIG. 3 illustrates the theater side of the theater tent with the curtain open. The theater tent 1 comprises fabric 13 placed over a frame 4. The frame 4 is made of rods 2 and joints 3. The theater tent 1 has a theater side 18 with a theater side opening 19. The refreshment stand side 5 has a refreshment opening 17, pocket 43 and clock 42. The refreshment stand side 5 also has message board 8. The theater side 18 has curtains 6 with fasteners 7. The curtains 6 have sashes 16. The theater side opening 19 has sides 14 and top 15. The theater tent 1 has a theater stage board 9. The theater stage board 9 has opening 10 and fasteners 11.

Figure 4:
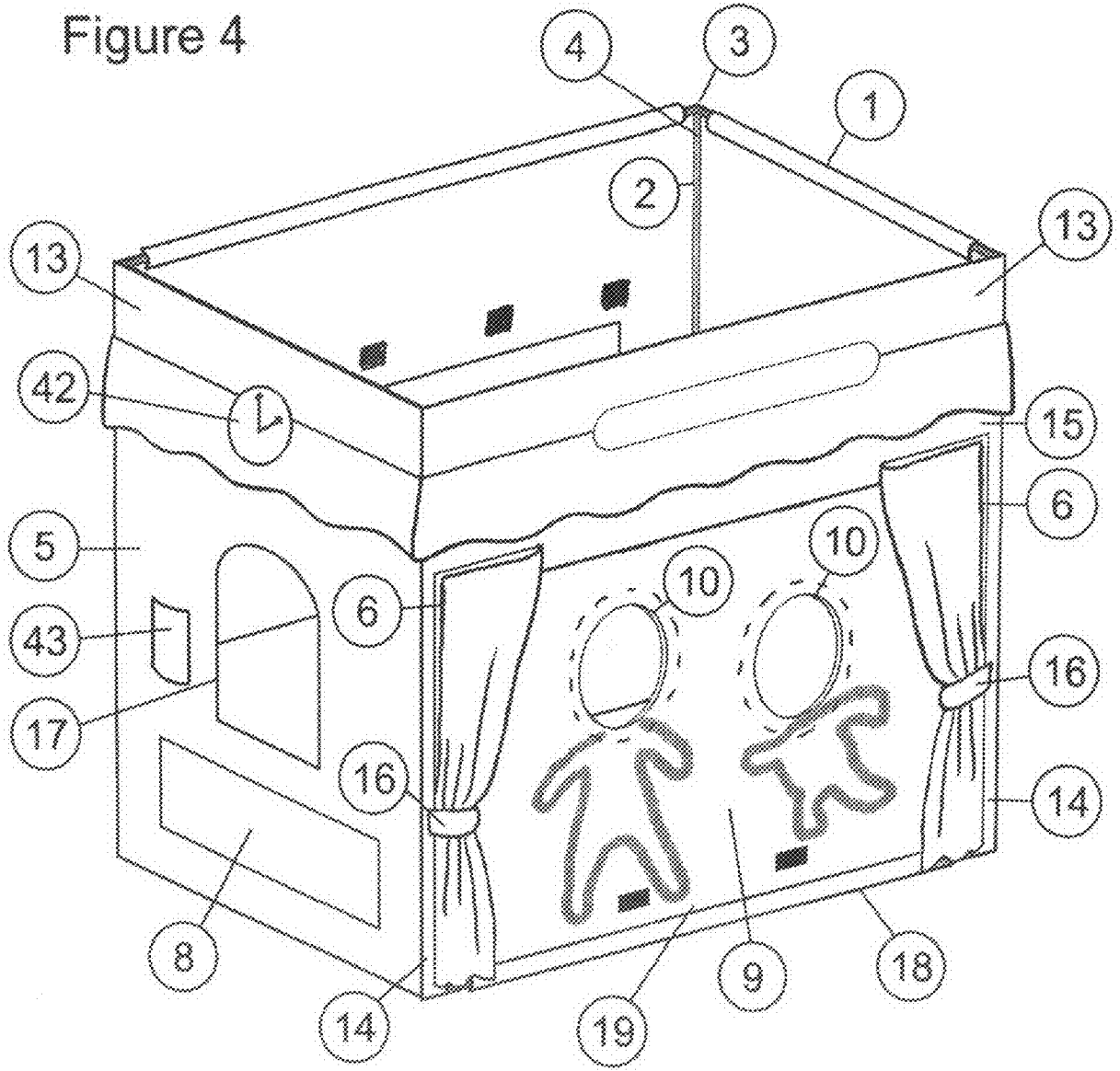
FIG. 4 is a picture of the theater side of the theater tent with the theater stage board in place.

FIG. 4 illustrates the theater side of the theater tent with the theater stage board in place. The theater tent 1 comprises fabric 13 placed over a frame 4. The frame 4 is made of rods 2 and joints 3. The theater tent 1 has a theater side 18 with a theater side opening 19. The refreshment stand side 5 has a refreshment opening 17, pocket 43 and clock 42. The refreshment stand side 5 also has message board 8. The theater side 18 has curtains 6. The curtains 6 have sashes 16. The theater side opening 19 has sides 14 and top 15. The theater tent 1 has a theater stage board 9. The theater stage board 9 has opening 10.

Figure 5:
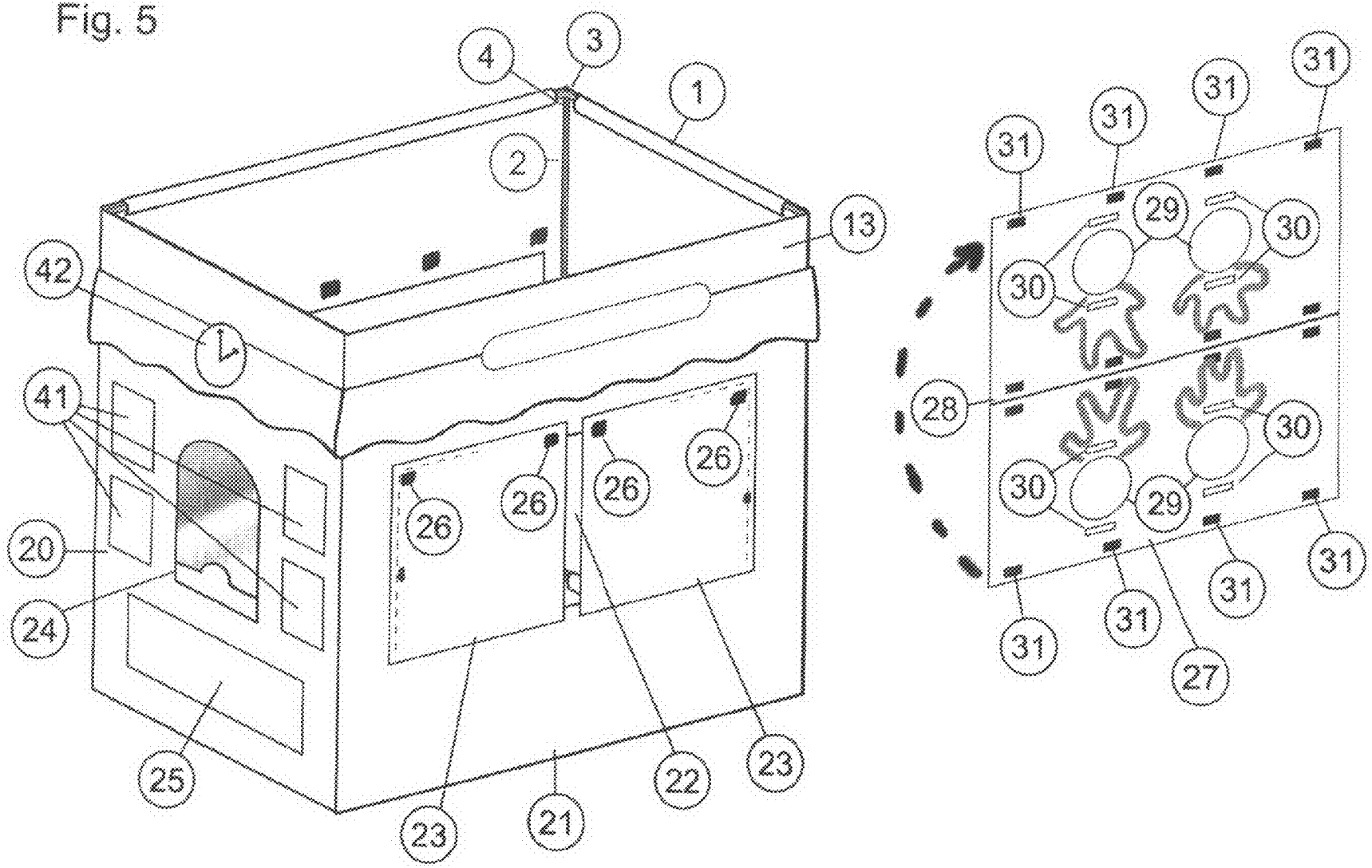
FIG. 5 is a picture of the puppet side of the theater tent.

FIG. 5 illustrates the puppet side of the theater tent. The theater tent 1 comprises fabric 13 over a frame 4. The frame 4 is made of rods 2 and joints 3. The theater tent 1 has a ticket booth side 20 and a puppet theater side 21. The ticket booth side 20 has a ticket window 24, a message board 25, a photo sleeve 41 and clock 42. The puppet theater side 21 has puppet theater opening 22. The puppet theater opening 22 has curtains 23 with fasteners 26. The puppet theater side 22 also has puppet stage board 27. The puppet stage board 27 folds at fold 28. The puppet stage board 27 has opening 29 and puppet attachment points 30 and fasteners 31.

Figure 6:
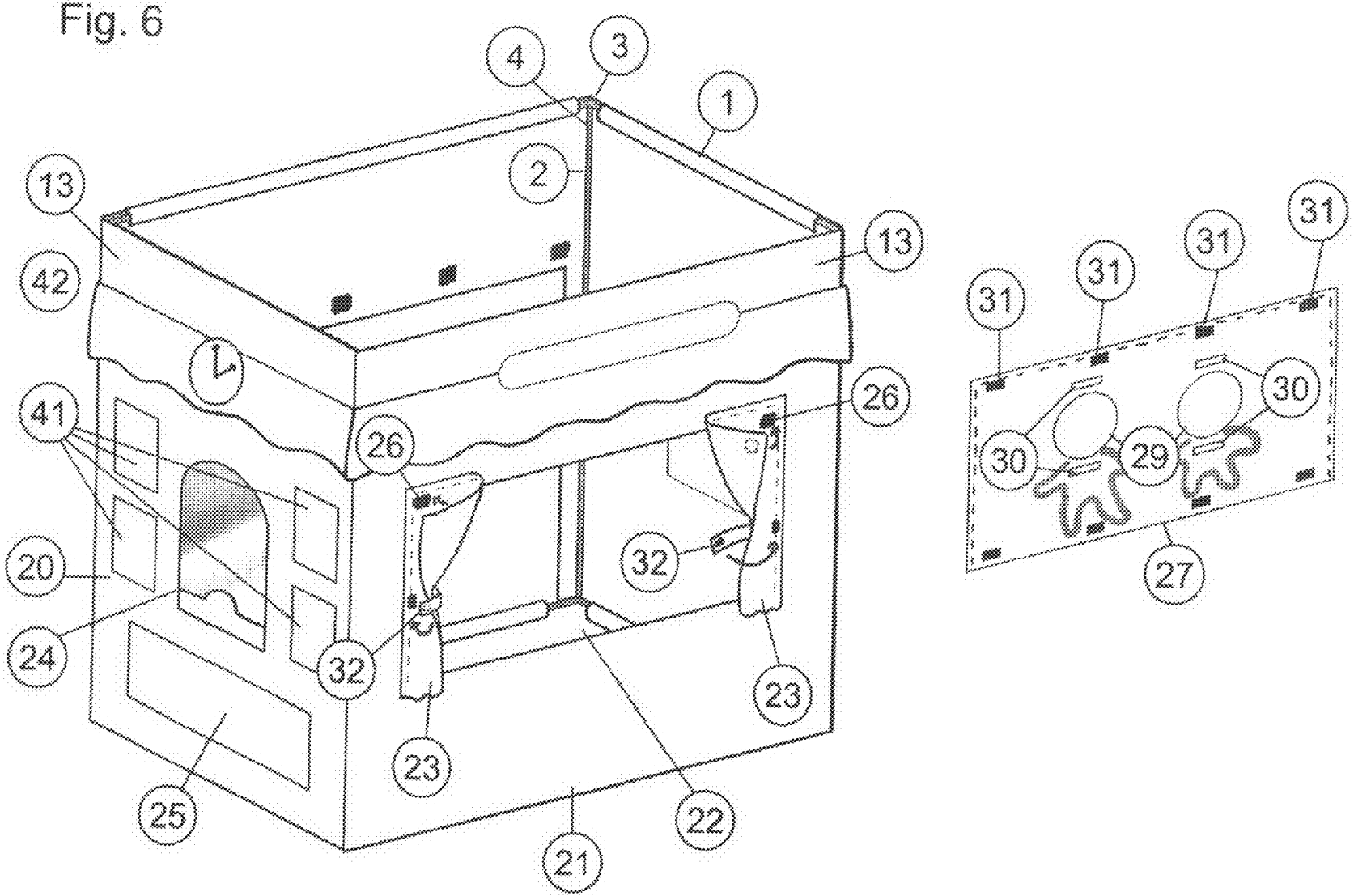
FIG. 6 is a picture of the puppet side of the theater tent with the curtain open.

FIG. 6 illustrates the puppet side of the theater tent with the curtain open. The theater tent 1 comprises fabric 13 over a frame 4. The frame 4 is made of rods 2 and joints 3. The theater tent 1 has a ticket booth side 20 and a puppet theater side 21. The ticket booth side 20 has a ticket window 24, a message board 25, a photo sleeve 41 and clock 42. The puppet theater side 21 has puppet theater opening 22. The puppet theater opening 22 has curtains 23 with fasteners 26. The curtains 23 have sashes 32. The puppet theater side 22 also has puppet stage board 27. The puppet stage board 27 has opening 29 and puppet attachment points 30 and fasteners 31.

Figure 7:
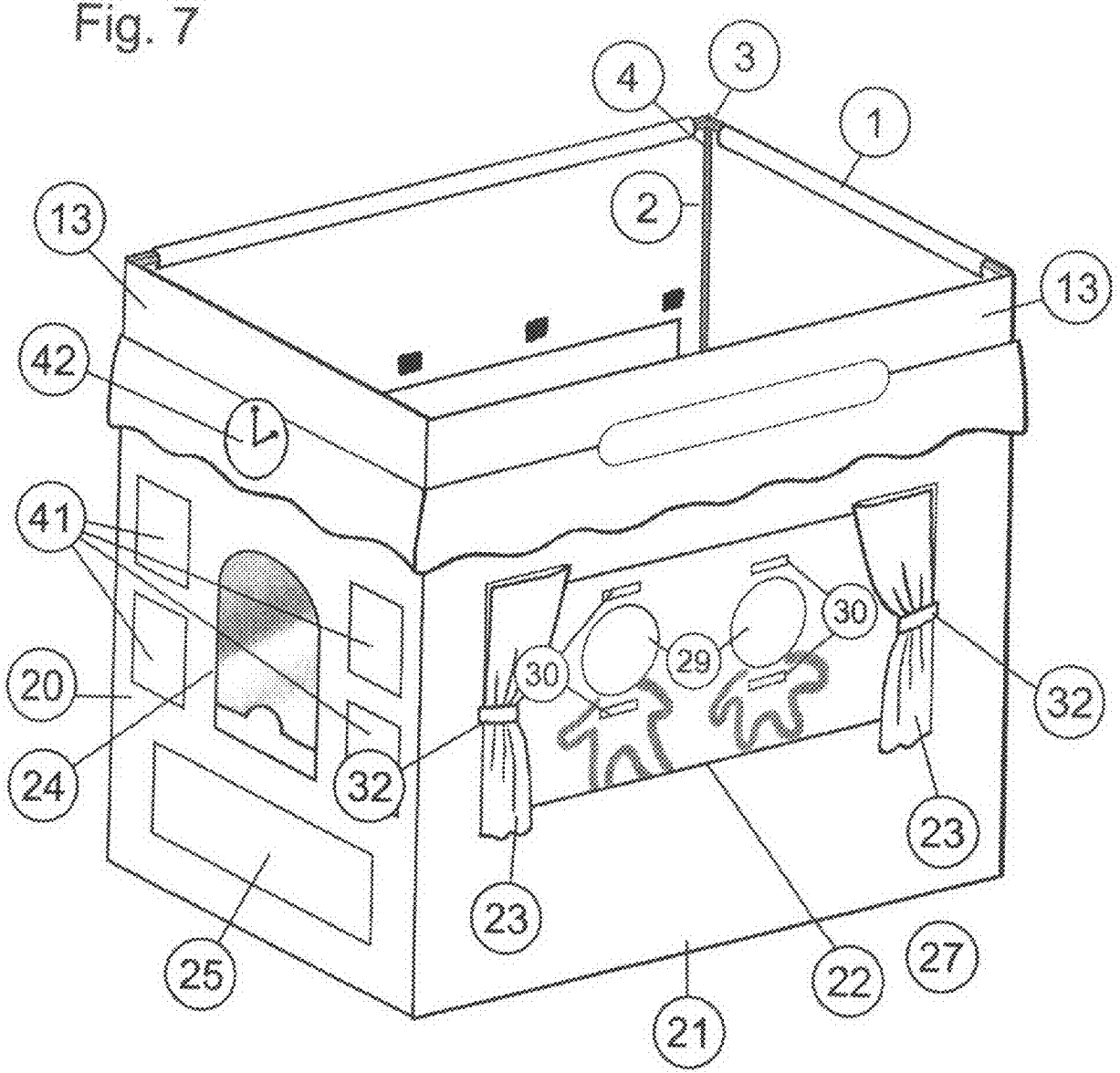
FIG. 7 is a picture of the theater tent with the puppet stage board in place.

FIG. 7 illustrates the theater tent with the puppet stage board in place. The theater tent 1 comprises fabric 13 over a frame 4. The frame 4 is made of rods 2 and joints 3. The theater tent 1 has a ticket booth side 20 and a puppet theater side 21. The ticket booth side 20 has a ticket window 24, a message board 25, a photo sleeve 41 and clock 42. The puppet theater side 21 has puppet theater opening 22. The puppet theater opening 22 has curtains 23 with fasteners 26. The curtains 23 have sashes 32. The puppet theater side 22 also has puppet stage board 27. The puppet stage board 27 has opening 29 and puppet attachment points 30.

Figure 8:
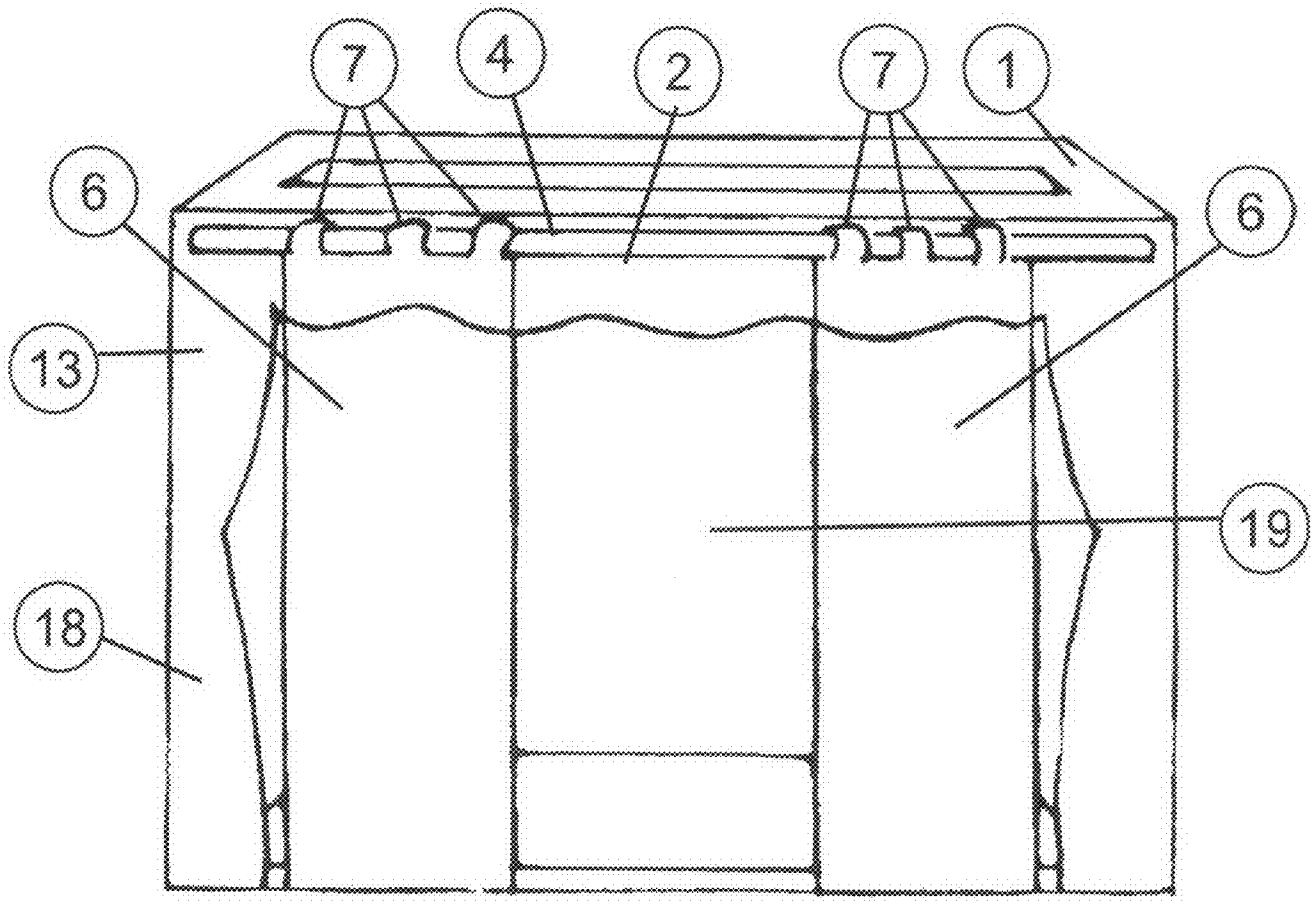
FIG. 8 illustrates one means of attachment for the curtains of the theater tent.

FIG. 8 illustrates one means of attachment for the curtains of the theater tent. The theater tent 1 can have the curtains 6 attached directly to the frame 4. In this version of the theater tent 1, the curtains 6 reversibly attach fasteners 7 to a rod 2 of the frame 4 so that the curtain can be moved to cover and reveal the theater side opening 19 on the theater side 18 of the theater tent 1. The figure also shows the fabric 13 that covers the frame 4.

Figure 9:
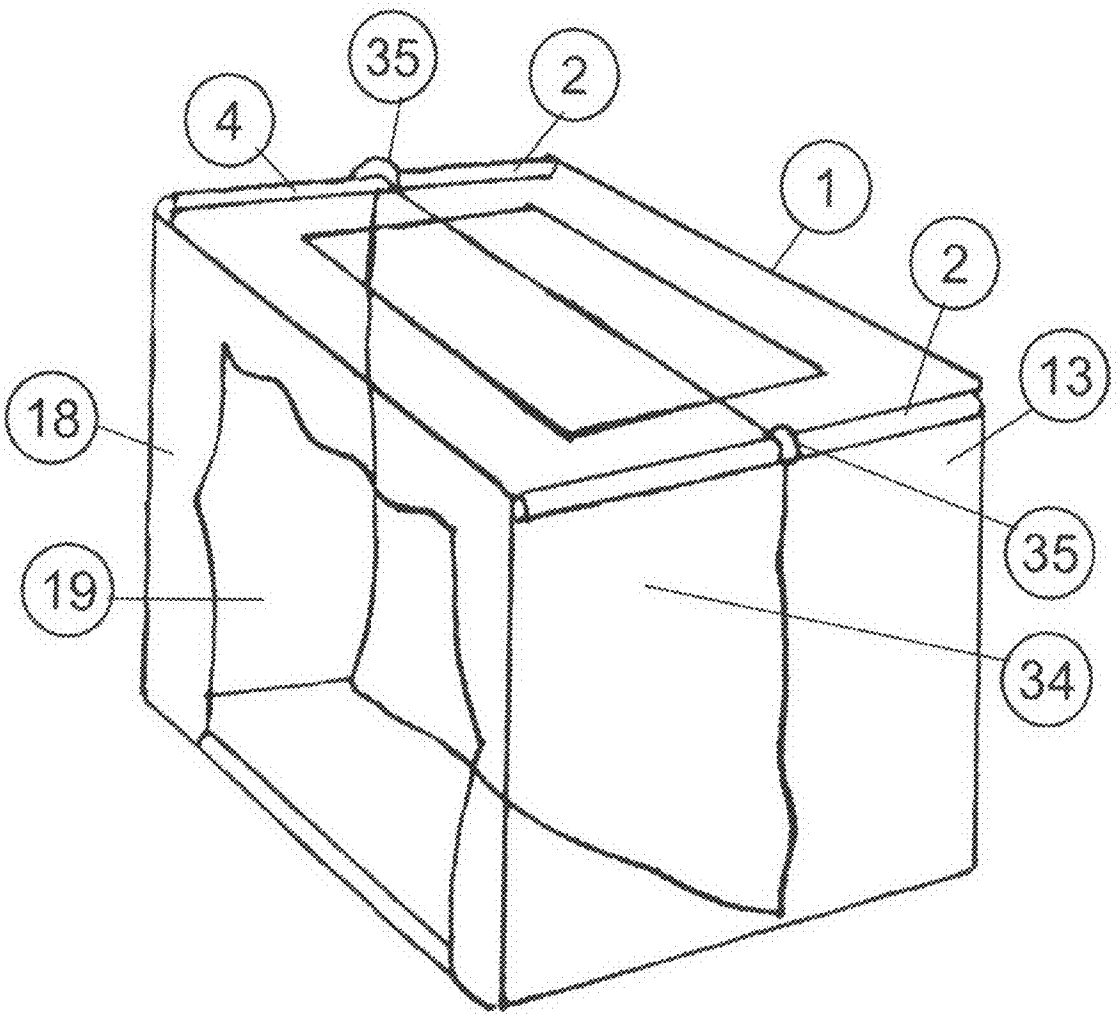
FIG. 9 illustrates a version of the theater tent with a backdrop.

FIG. 9 illustrates a version of the theater tent with a backdrop. The theater tent 1 can have a backdrop 34. The backdrop 34 reversibly attaches to the rods 2 of the frame 4 using fasteners 35. The backdrop 34 is positioned so that it serves as a backdrop to theater side opening 19 of theater side 18. The figure also shows the fabric 13 that covers the frame 4.

Figure 10:
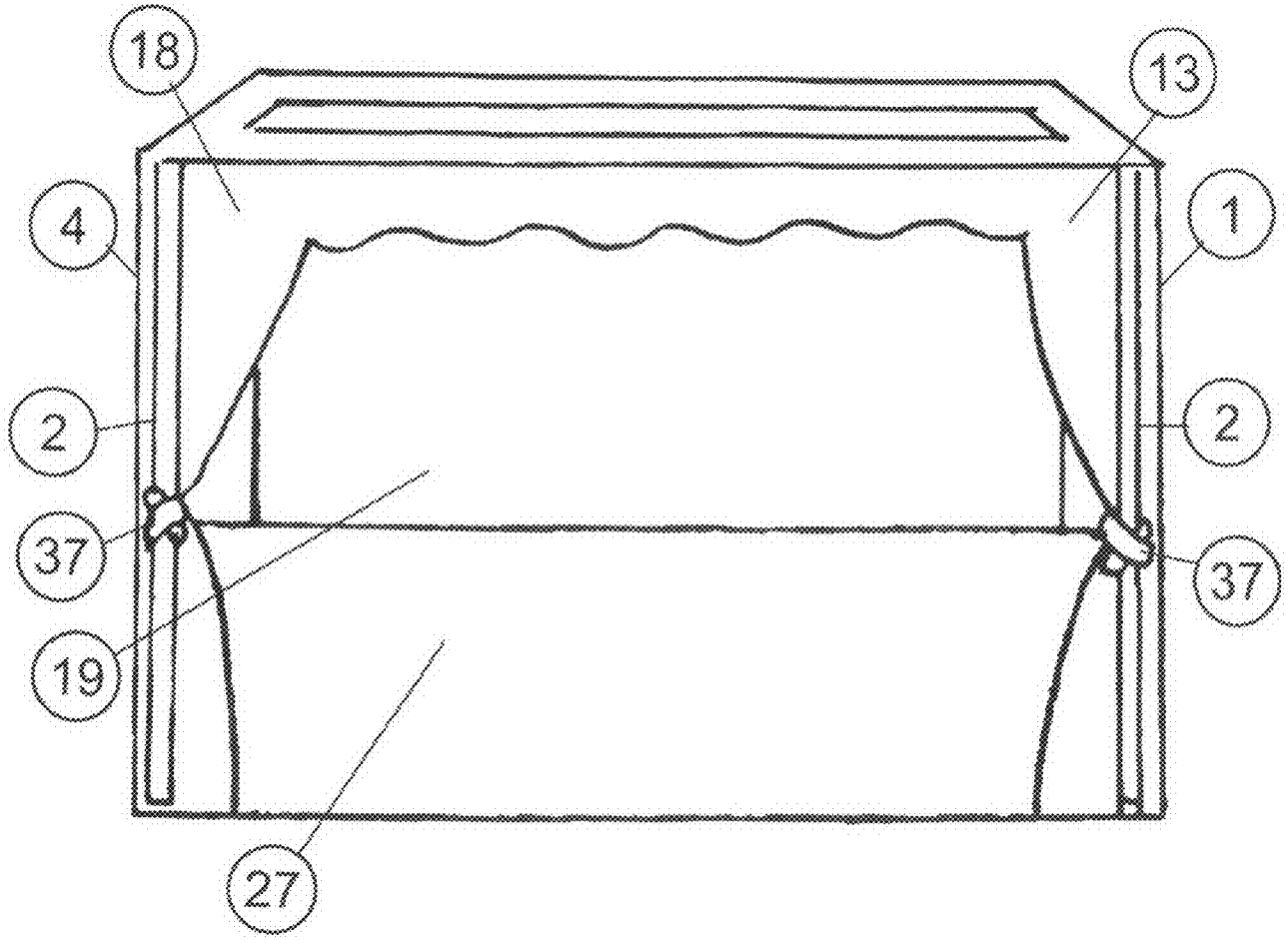
FIG. 10 illustrates a version of the theater tent with a puppet stage board attached to the theater side of the theater tent.

FIG. 10 illustrates a version of the theater tent with a puppet stage board attached to the theater side of the theater tent. The theater tent 1 has frame 4 and fabric 13 covering frame 4. The theater side 18 has theater side opening 19. Part of the theater side opening 19 is covered by puppet stage board 27. Puppet stage board 27 can be reversibly attached to the frame 4 by fasteners 37 that are reversibly attached to rods 2 of the frame 4.

Figure 11:
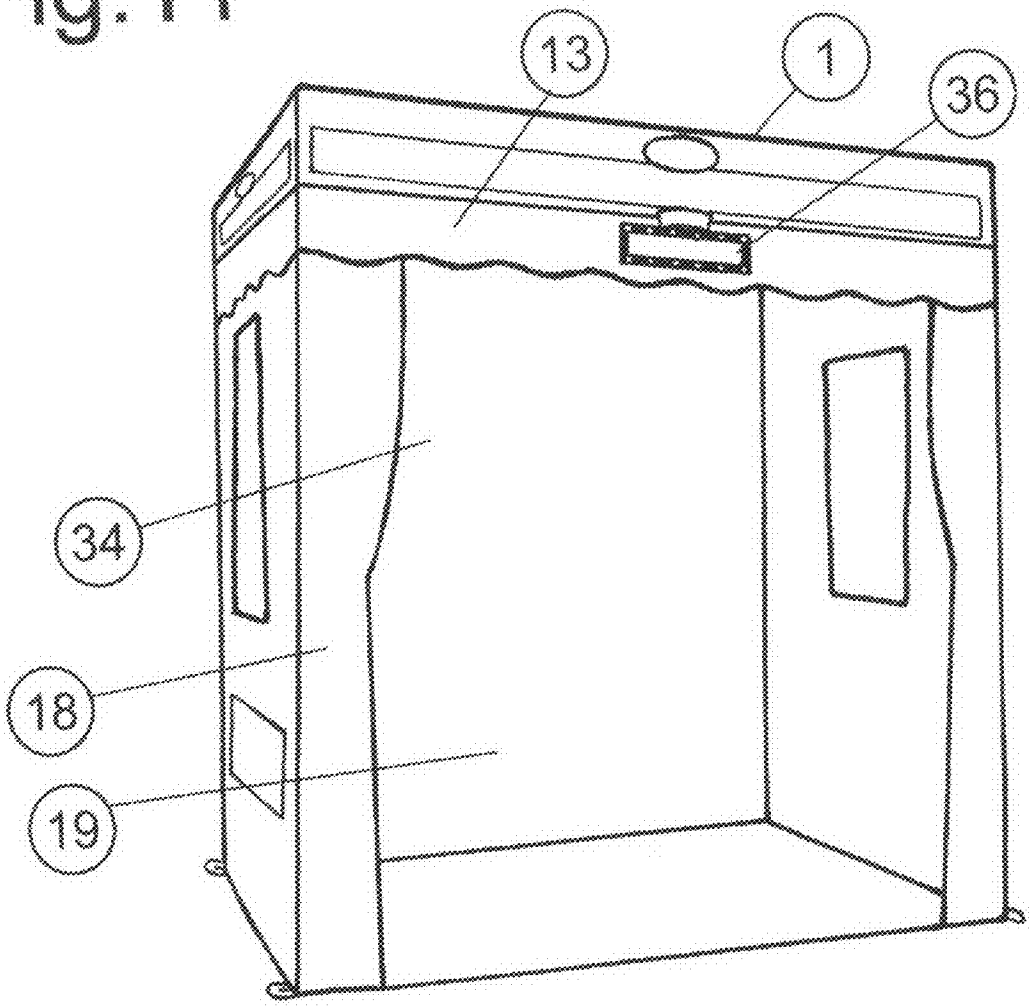
FIG. 11 illustrates the theater side of the theater tent.

FIG. 11 illustrates the theater side of the theater tent. The theater tent 1 has fabric 13 and theater side 18 and theater side opening 19. Inside theater side opening 19, the backdrop 34 is visible. Above the theater side opening 19 is a marquee 36.

Figure 12:
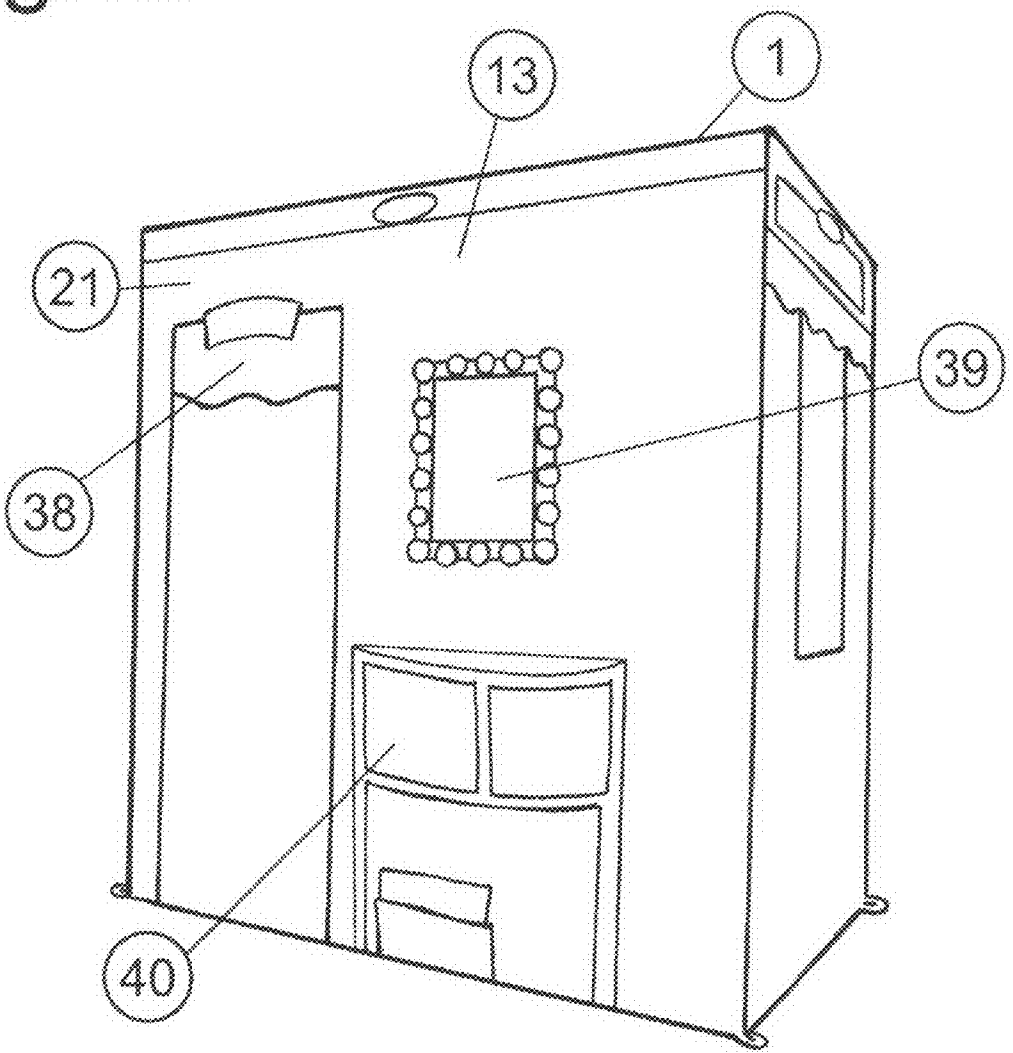
FIG. 12 illustrates an alternative version of the puppet theater side of the theater tent.

FIG. 12 illustrates an alternative version of the puppet theater side of the theater tent. This configuration of the puppet theater side 21 of the theater tent 1 has the puppet theater side 21 set up as a dressing room. The dressing room configuration of the puppet theater side 21 includes the fabric 13, a door opening 38, a reflective surface 39 and accessory pockets 40.

The frame 4 is made of rods 2 and joints 3. The rods 2 can be made of any rigid material. In the preferred embodiment, the rods 2 are made of plastic. Rods 2 could also be made of fiberglass, wood, metal, aluminum or carbon. The rods 2 are held together by joints 3. The joints 3 could be any means that holds the rods 2 together. The preferred embodiment envisions the joints 3 as receptacles that the rods 2 can fit into. The joints 3 could also be made of plastic, fiberglass, wood, metal, aluminum or carbon.

The overall shape of the frame 4 is any shape that a child can stand within. The frame 4 has a top portion 32 and a bottom portion 33. The top portion 32 of frame 4 is the portion not touching the ground. The bottom portion 33 of the frame 4 is the portion that is touching the ground. The preferred embodiment is a cube. Alternatively, the theater tent 1 could be a rectangle or box.

The fabric 13 of the theater tent 1 is any fabric that can fit over the frame 4. The preferred embodiment envisions a plastic fabric 13 such as nylon. Any other fabric 13 could be used, such as cotton, polyester or rayon. Another embodiment could use wood planks as a replacement for the fabric 13. Yet another embodiment of fabric 13 could be cardboard. Yet another embodiment of the fabric 13 could be molded plastics. The theater tent 1 can have the topside or the bottom side that is open. Alternatively, the topside or the bottom side could be closed.

The fasteners 7 can be any fasteners. The preferred embodiment envisions a statistical fastener or a hook and loop fabric, such as VELCRO. The fasteners 7 can reversibly attach curtains 6 to the frame 4 of the theater tent 1. The curtains 6 can be attached to the top portion of frame 4.

The fasteners 26 can be any fasteners. The preferred embodiment envisions a statistical fastener or a hook and loop fabric, such as VELCRO.

The theater side 18 has a theater side opening 19. This theater side opening 19 can be envisioned as a stage. The preferred embodiment of the invention has the theactical performance take place inside the theater side opening 19 as if the theater side opening 19 was a full sized stage. The preferred embodiment envisions a theater side opening 19 wide enough for five children to act or operate within the theater tent 1.

The message board 8 can be made of dry erase board. Alternatively, the message board 8 could be made of blackboard. Alternatively the message board 8 could be made of paper. The paper version of message board 8 could be a single piece of paper, or could be a pad of paper with a plurality of sheets of paper. Some embodiments of the theater tent 1 do not include the message board 8. Some embodiments of message board 8 could include lights. Some embodiments of the theater tent 1 could include a plastic sleeve to hold the message board 8. The message board 8 can have different elements or features on each side.

The message board 25 can be made of dry erase board. Alternatively, the message board 25 could be made of blackboard. Alternatively the message board 25 could be made of paper. The paper version of message board 25 could be a single piece of paper, or could be a pad of paper with a plurality of sheets of paper. Some embodiments of the theater tent 1 do not include the message board 25. Some embodiments of message board 25 could include lights. Some embodiments of the theater tent 1 could include a plastic sleeve to hold the message board 25. The message board 25 can have different elements or features on each side.

The theater stage board 9 can be made of any material. The preferred embodiment envisions dry erase board. An alternative embodiment of theater stage board 9 is a board covered with fabric that a statistical fastener or hook and loop fabric, such as VELCRO, can attach to. The theater stage board 9 could also be made of fabric. The theater stage board 9 can be decorated to act as decoration for a scene. The theater stage board 9 can be arranged so that children can color pre-drawn images, or the theater stage board 9 be decorated with a specific theme or character. An alternative theater stage board 9 could be made of fabric.

The theater stage board 9 has holes 10. The holes 10 allow a child to fit their head through the hole. The theater stage board 9 can be decorated so that the child can assume the role of the character drawn on the theater stage board 9 by fitting the child's head through the hole 10. The theater stage board 9 can have any number of holes 10. The preferred embodiment envisions a theater stage board 9 with two holes 10.

The theater stage board 9 has fasteners 11. These fasteners 11 can attach to the fasteners 7 on the theater side 18 of the theater tent 1. An alternative embodiment of the theater stage board 9 can attach to the rods 2 of frame 4 by fasteners 11.

The puppet stage board 27 can be made of any material. The preferred embodiment envisions dry erase board. An alternative embodiment of the puppet stage board 27 is a board covered with fabric that a hook and loop fabric, such as VELCRO, can attach to. In another alternative embodiment, the puppet stage board 27 can be reversibly attached to the theater side opening 19 of the theater side 18 of the theater tent 1. Some embodiments of this version of the invention may not have a puppet theater opening 22 on the puppet theater side 21 of the theater tent 1. The puppet stage board 27 could also be made of fabric.

The puppet stage board 27 can be decorated to display and scene. The puppet stage board 27 can have a pre-drawn image that children can color. Alternatively, the puppet stage board 27 can be decorated with a theme or character.

The puppet stage board 27 has holes 29. The holes 29 allow a child to fit a puppet through the hole. The puppet stage board 27 can be decorated so that the puppet can assume the role of the character drawn on the puppet stage board 27 by fitting the puppet through the hole 29. The puppet stage board 27 can have any number of holes 29. The preferred embodiment envisions a puppet stage board 27 with two holes 29. The holes 29 can be placed at any spot on the puppet stage board 27. One embodiment has the holes 29 in the middle of the puppet stage board 27. Other embodiments have the holes 29 at a seam in the puppet theater side 21 of the theater tent 1. Some versions of the theater tent 1 do not have holes 29.

The puppet stage board 27 can also have a puppet attachment point 30. The puppet attachment point 30 is any means to secure a puppet the puppet stage board 27. A preferred embodiment of the puppet attachment point 30 is U.S. Pat. No. 6,672,929 by Lisa Leleu. Another preferred embodiment of the puppet stage board 27 would not have a puppet attachment point 30. Some versions of the theater tent 1 do not have puppet attachment points 30, such as the example in FIG. 10.

The puppet stage board 27 has fasteners 31. These fasteners 31 can attach to the fasteners 26 on the puppet theater side 21 of the theater tent 1. In version of the invention, puppet stage board 27 is reversibly attached to the theater side opening 19 by fasteners 37. Fasteners 37 reversibly attach to the rods 2 of frame 4. Fasteners 26,31 and 37 can be any type of fastener. As examples and not meant as a limitation in any way, fasteners 26, 31 and 37 can be buttons, snaps, ties, hook and loop fasteners, hook and loop fabric such as VELCRO, magnets, or adhesives. A person skilled in the art will see that other fasteners can also be used. The puppet stage board 27 can be permanently or reversibly attached to the theater tent 1.

The message board 8, message board 25, theater stage board 9 and puppet stage board 27 can also be panels. Each can be made of wood, cardboard, dry-erase board, blackboard, plastic, metal, cloth, fabric, vinyl, rubber, foam, or any other material. Each can be rigid or flexible. Each can have decorations attached or drawn onto the message board 8, message board 25, theater stage board 9, or puppet stage board 27.

The theater tent 1 can also have a backdrop 34. Backdrop 34 can be reversibly attached to frame 4 by fasteners 35. Fasteners 34 can be any type of fastener. As examples and not meant as a limitation in any way, fasteners 34 can be buttons, snaps, ties, hook and loop fasteners, hook and loop fabric such as VELCRO, magnets, or adhesives. A person skilled in the art will see that other fasteners can also be used. Backdrop 34 can be made of any material. Backdrop 34 can be rigid or flexible. Backdrop 34 can be a board, a sheet of material, or a sheet of fabric. In the preferred embodiment, the backdrop 34 is a sheet of fabric. A person skilled in the art can be that other materials could be used The marquee 36 is any board or sign that can carry a message. The marquee 36 can be attached to the theater tent 1 fabric 13 by any means. In the preferred embodiment, the marquee 36 has lights and has a dry erase surface that can have messages written on the marquee 36. In the preferred embodiment, the marquee 36 is slipped into a clear plastic sleeve. The marquee 36 can also have a pocket to hold a pen or other drawing instrument.

In the dressing room configuration of the puppet theater side 21, the puppet theater side 21 does not have a puppet theater opening 22. In this configuration, the puppet theater side 21 has a door opening 38, a reflective surface 39 and accessory pockets 40. The door opening 38 can have a covering, such as a curtain, or cannot have a covering. The reflective surface 39 can be a mirror. The accessory pockets 40 can be of any size. There can be one accessory pocket 40 or a plurality of accessory pockets 40.

The refreshment stand side 5 has a refreshment opening 17, pocket 43 and clock 42. The refreshment stand side 5 also has message board 8. Pocket 43 can be used to hold a menu. The number of pockets 43 can be one or a plurality. The pockets 43 can be of any size. The pockets 43 can had messages. The pockets 43 can be made of plastic or fabric.

The ticket booth side 20 has a ticket window 24, a message board 25, a photo sleeve 41 and clock 42. The ticket booth side 20 can have a single photo sleeve 41 or a plurality of photo sleeves 41. The photo sleeves 41 can be made of plastic or mesh. The photo sleeves 41 can be of any size.

Although this invention has been illustrated by reference to specific embodiments, it will be apparent to those skilled in the art that various changes and modification may be made which clearly fall within the scope of the invention. The invention is intended to be protected broadly within the spirit and scope of the appended claims.

What is claimed is:

1. A collapsible theater comprising a tent comprising:
- a frame comprising:
  - plural poles; and
  - plural joints;
- a flexible shell; and
- at least one curtain;
- wherein the frame has a frame top, frame sides, and a frame bottom;
  - wherein the poles comprise frame top poles, frame side poles, and frame bottom poles;
  - wherein each of the joints:
    - is non-articulating; and
    - comprises receptacles into which the poles fit;
  - wherein the poles are removably attached to each other by means of the joints; and
  - wherein each frame side is removably attached to two adjacent frame sides;
- wherein the flexible shell:
  - fits around the exterior of the frame; and
  - comprises at least one opening;
- wherein the curtain:
  - is movably and reversibly attached to the frame top pole by means of one or more fastener, in such a way as to approximately cover at least one opening;
  - is, optionally, attached by means of one or more fastener to one or both of: frame side poles, and flexible shell; and
  - can be moved, without detaching the curtain from the frame, to reveal the at least one opening;
- wherein the tent has a tent top, tent sides, and a tent bottom, wherein:
  - the tent top comprises the frame top and any of the flexible shell covering the frame top;
  - each tent side comprises one frame side and any of the flexible shell covering that frame side; and
  - the tent bottom comprises the frame bottom and any of the flexible shell covering the frame bottom; and
- wherein one tent side is a theater side further comprising:
  - a theater opening;
  - a puppet stage board reversibly attached, by means of fasteners, to one or both of:
    - the frame side poles on the theater side; and
    - the flexible shell,
    - wherein the puppet stage board, optionally, comprises one or more hole large enough to allow a puppet to fit through; and
  - optionally, one or more curtain.

2. The collapsible theater of claim 1, further comprising a backdrop reversibly attached to two frame top poles by means of one or more fastener, wherein the backdrop is positioned so that it serves as a backdrop to the theater opening.

3. The collapsible theater of claim 1, wherein the theater side further comprises a marquee above the theater opening.

4. The collapsible theater of claim 1, wherein the tent sides further comprise one or more of:
- a ticket booth side further comprising:
  - a ticket window opening; and
  - optionally, one or more curtain;
- a refreshment stand side further comprising:
  - a refreshment opening; and
  - optionally, one or more curtain;
- a puppet theater side further comprising:
  - one or more puppet theater opening, wherein the puppet theater opening is large enough to allow at least one puppet to fit through; and
  - optionally, one or more curtain;
- a dressing room side further comprising one or more reflective surface; and
- a door side further comprising:
  - a door opening; and
  - optionally, one or more curtain.

5. The collapsible theater of claim 4, wherein:
- the ticket booth side further comprises one or more of: clock, photo sleeve, and message board;
- the refreshment stand side further comprises one or more of: clock, menu pocket, message pocket, and message board;
- the puppet theater side further comprises one or more of:
  - marquee;
  - pocket for drawing instruments; and
  - the puppet stage board reversibly attached, by means of one or more fastener, to one or both of:
    - the frame side poles on the puppet theater side; and
    - the flexible shell,
    - wherein the puppet stage board, optionally, comprises one or more hole large enough to allow a puppet to fit through; and
- the dressing room side further comprises one or more of: clock, storage pocket, and a door opening to the theater side.

6. The collapsible theater of claim 5, wherein the message board comprises:

one or more of: dry erase board, blackboard, single page of paper, and paper pad having a plurality of sheets of paper; and optionally, one or more light.

7. The collapsible theater of claim 1, wherein the frame has an approximate shape of a cube.

8. The collapsible theater of claim 1, wherein at least two of the frame sides are of unequal length.

9. The collapsible theater of claim 1, wherein the puppet stage board further comprises one or more of: dry erase board; board covered with fabric that is a hook and loop fabric; and fabric.

10. The collapsible theater of claim 1, wherein the tent sides further comprise:

a ticket booth side further comprising:

a ticket window opening; and optionally, one or more curtain;

a refreshment stand side further comprising:

a refreshment opening; and optionally, one or more curtain; and a fourth tent side selected from:

a puppet theater side further comprising:

one or more puppet theater opening, wherein the puppet theater opening is large enough to allow at least one puppet to fit through; and optionally, one or more curtain;

a dressing room side further comprising one or more reflective surface; and a door side further comprising:

a door opening; and optionally, one or more curtain.

11. The collapsible theater of claim 10, wherein:

the ticket booth side further comprises one or more of: clock, photo sleeve, and message board;

the refreshment stand side further comprises one or more of: clock, menu pocket, message pocket, and message board;

the puppet theater side further comprises one or more of:

marquee;

pocket for drawing instruments; and the puppet stage board reversibly attached, by means of one or more fastener, to one or both of:

the frame side poles on the puppet theater side; and the flexible shell, wherein the puppet stage board, optionally, comprises one or more hole large enough to allow a puppet to fit through; and the dressing room side further comprises one or more of: clock, storage pocket, and a door opening to the theater side.

12. The collapsible theater of claim 11, wherein the message board comprises:

one or more of: dry erase board, blackboard, single page of paper, and paper pad having a plurality of sheets of paper; and optionally, one or more light.

13. The collapsible theater of claim 11, wherein the puppet stage board further comprises one or more of: puppet attachment point; marquee optionally having lights; and pocket for drawing instruments.

14. The collapsible theater of claim 1, wherein the joint has three receptacles.

* * * * *